United States Patent [19]

Hufenus

[11] 4,027,881

[45] June 7, 1977

[54] TENNIS RACKET WITH VARIABLE BALANCE AND WEIGHT

[76] Inventor: Paul Francis Marcel Hufenus, 16 Rue de la Coste, 34 110 Frontignan, France

[22] Filed: Dec. 23, 1974

[21] Appl. No.: 537,105

[30] Foreign Application Priority Data

May 13, 1974 France ..... 74.16392

[52] U.S. Cl. ..... 273/73 R; 273/73 G

[51] Int. Cl.[2] ..... A63B 49/04

[58] Field of Search ..... 273/26 B, 29 A, 67 R, 273/67 A, 68, 72 R, 73 R, 73 C, 73 D, 73 E, 73 F, 73 G, 73 H, 73 J, 80 D, 162 R, 165, 193 R, 194 R, 194 B; 272/57 A, 59 C, DIG. 4, 122; 124/45; 280/11.13 K; 177/246, 250, 251

[56] References Cited

UNITED STATES PATENTS

| | | | |
|---|---|---|---|
| 1,186,283 | 6/1916 | Coddington | 273/73 H |
| 1,587,918 | 6/1926 | Morrison | 273/73 J |
| 2,215,899 | 9/1940 | Beasley | 273/73 J X |
| 2,368,984 | 2/1945 | Hart | 177/250 |
| 2,395,864 | 3/1946 | Geerlings et al. | 273/73 J |
| 2,677,544 | 5/1954 | Desselman | 272/59 C |
| 2,777,692 | 1/1957 | Marzucco | 272/59 C |
| 3,135,344 | 6/1964 | Olyphant | 177/246 |
| 3,310,320 | 3/1967 | Hanna et al. | 272/57 A X |
| 3,392,976 | 7/1968 | Hayes | 273/26 B X |
| 3,414,260 | 12/1968 | Gust | 273/29 A X |
| 3,834,697 | 9/1974 | McNamara et al. | 273/73 R X |
| 3,834,722 | 9/1974 | Rainer | 273/80 D X |
| 3,931,968 | 1/1976 | Hedberg | 273/73 J X |

FOREIGN PATENTS OR APPLICATIONS

| | | | |
|---|---|---|---|
| 2,031,783 | 11/1970 | France | 273/73 C |
| 1,031,855 | 3/1953 | France | 272/122 |
| 310,350 | 4/1929 | United Kingdom | 273/73 J |
| 447,638 | 5/1936 | United Kingdom | 273/73 J |

*Primary Examiner*—Richard J. Apley
*Attorney, Agent, or Firm*—Brisebois & Kruger

[57] ABSTRACT

A tennis racket with variable balance and weight, has a device comprising a movable member slidable along a shaped guide member between the base of the frame and the end of the handle which is gripped by the hand. The movable member and the guide member comprise cooperating structure for fastening the movable member in place and releasing it, said structure cooperating so that the release and movement of the movable member from one position to another on the guide member may be effected instantaneously even with a single finger by a simple thrust against the movable member or by the combination of pressure and thrust against the movable member. The movable member is thus located instantaneously at any position on the guide member.

11 Claims, 18 Drawing Figures

Fig:1
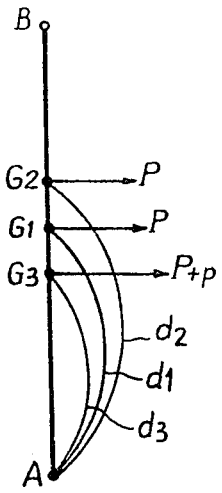
Fig:2
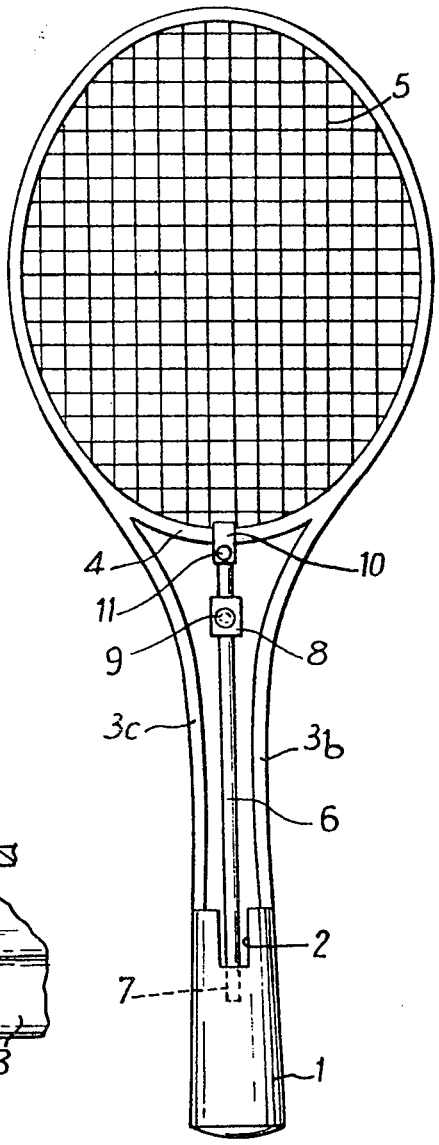
Fig:3A
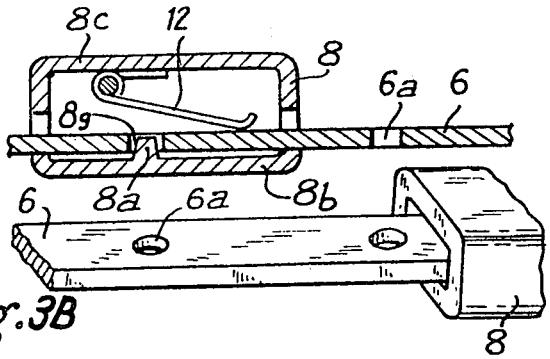
Fig:3B
Fig:4
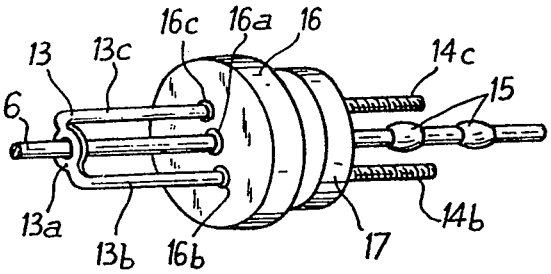

Fig: 5A
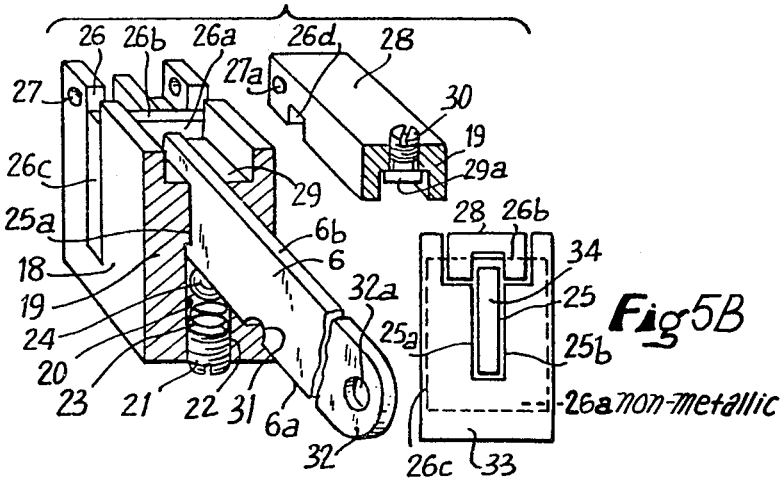
Fig 5B
Fig: 6
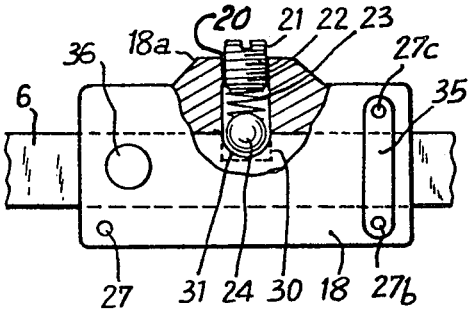
Fig: 7
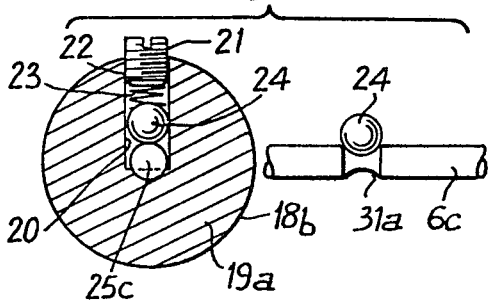
Fig: 9
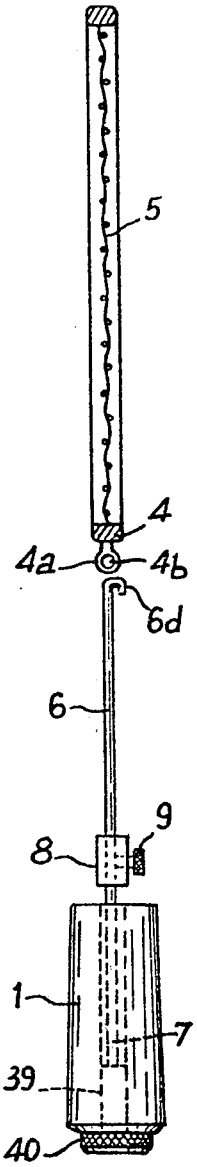
Fig: 8
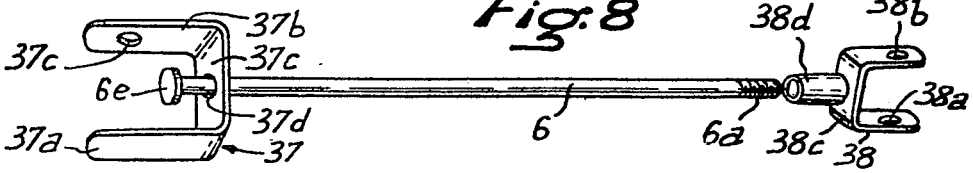

TENNIS RACKET WITH VARIABLE BALANCE AND WEIGHT

The present invention relates to a tennis racket whose centre of gravity can be varied, by means on the part of the racket located above the "grip", and this with or without modification of the weight of the racket. The term "grip" is used to denote the end of the handle for holding the racket.

The choice of balance and weight of a racket always poses a problem to the tennis player. In fact, a so-called "head-balanced" racket, that is to say, one whose centre of gravity is located towards the head of the racket, is more suitable for base-line play and for service, whilst the so-called "head-light" racket that is to say whose centre of gravity is located towards the handle of the racket, is more suitable for volleying.

These two advantages sought according to the various phases of play incompatible, the player must select one of these two types of balance, but he may also accept a compromise solution and select a racket called "well-balanced", that is to say a racket whose centre of gravity occupies a middle position with respect to the head and the handle of the racket; such a racket then not having any particular advantage for one type of play over another.

It is an object of the invention to provide a racket whose centre of gravity can be moved along the part situated above the grip and which will be called below "racket head", with or without modification of the weight of the racket and according to a very wide range of combinations, by means of a device incorporated with the racket or adapted to be attached to the racket.

The racket according to the invention comprises:

a. at least one guide member attached at one end to the base of the frame of the racket and at its other end to the grip;

b. a movable element whose weight can be modified, and which is slidable freely along the guide element between the base of the frame and the grip;

c. means permitting the movable element to be immobilized at any position on the guide element and to render it movable again;

d. one or more continuous cavities in the handle permitting the afore-said immobilizing and releasing means to be reached at any of their positions.

e. means for attaching the guide member to the racket frame and to the grip.

The movement of the centre of gravity of the racket so obtained depends therefore, either on the movement of the afore-said movable element, or on the modification of its weight for a given position, or on both the movement of the movable element and on the modification of its weight.

According to the invention, the movement of the point of application of a member having a weight of the order of several tens of grams, and over a total distance of the order of 15 to 25 centimetres between the grip and the frame of the racket, has the result of considerably displacing the centre of gravity of the the racket. The said displacement of the centre of gravity may again be increased or diminished with respect to the initial position, as the weight of the movable element is increased or reduced.

The considerable range of possibilities of adjustment of the characteristics of the racket is demonstrated by FIG. 1 in which A represents the limiting point of the movement of the movable member towards the grip, B represents the limiting point of the movement of the movable member towards the frame, $G_1$ and $G_2$ are two positions of the centre of gravity when the movable member is displaced by being spaced away from the grip for a total weight P of the racket head, and $G_3$ being the centre of gravity corresponding to a position of the movable member closer to the grip than in the cases of $G_1$ and $G_2$, but for a total weight $P_3 = P + p$, $p$ being a given increase in the weight of the movable member.

If $d_1 = AG_1$, $d_2$ and $d_3 = AG_3$ are the respective distances between A and the afore-mentioned centres of gravity $G_1$, $G_2$, $G_3$, it is seen that, for a racket placed in the horizontal plane and held by the grip, the moment $d_1 \times P$ is less than the moment $d_2 \times P$, and that $P_3$ can be given a value such that the moment $d_3 \times P_3$ is either less than $d_1 \times P$ or greater than $d_2 \times P$, or again comprised between these two values.

Hence not only can the moment be varied by moving the movable member, thus varying the centre of gravity with the weight P remaining constant, but also P and $d$ can be made to vary at the same time so that the value of the moment remains unchanged if so desired.

The range of adjustment of the racket according to the invention is hence very wide, so that the weight and the centre of gravity of the racket head can be adjusted at any phase of play and also according to the morphology of the player.

According to the invention therefore there is provided a tennis racket with variable balance and weight, provided with a device comprising a movable member slidable along a shaped guide member between the base of the stringed area of the racket and the grip, the movable member and the guide member comprising fastening and releasing means for the movable member which cooperate so that the release and movement of the movable member from one position to another on the guide member are effected instantaneously by a simple push against the movable member, and so that the movable member is instantaneously located at any position on the guide member .

According to a particular feature of the invention there is provided a racket in which the afore-said means comprise, on the one hand recesses in the guide member designed to receive pins, and on the other hand, inside the movable member, a spring which holds the pins in recesses so that, without requiring any dismantling, the pin can be extracted from a recess by simple pressure of the finger on the movable member, the latter thus being movable instantaneously from one position to another on the guide member.

Using another feature of the racket according to the invention, the fastening and releasing means for the movable member comprise on the one hand pairs of bosses on a rod constituting the guide member and, on the other hand, a weighting member forming part of the movable member and threaded on the rod by an orifice having a cross-section at least equal to that of the bosses, and a braking member made of elastic material threaded on the rod through an orifice having a cross-section slightly less than that of the bosses, the weighting member and the braking member being attached to each other, so that the braking member ensures the fixing of the movable member assembly when it is positioned between two bosses and permits the release and movement of the movable member by simply pushing it along the rod.

The pairs of bosses may be replaced by circular grooves on the rod, the braking member being threaded on to the rod through an orifice having a cross-section slightly less than that of the rod.

Using another feature, the guide member is constituted by a stretched cable (or two parallel cables), of a sufficiently strong material, such as metallic cable or one of plastic material, the movable member comprising a channel (or two channels), through which the cable passes and which causes a deflection of the cable, thus fastening the movable member which can be simply pushed along the cable.

Another feature is the provision of improved fastening and release means for the movable member, the latter comprising on the one hand recesses in the guide member and on the other hand, an assembly housed in a well of the movable member perpendicular to the axis of the guide member, said comprising a ball adapted to fit into the recesses in the guide member, a spring mounted on this ball and a screw which, by displacement through the tapped end of the screw hole, compresses the spring and holds the ball in the recesses in the guide member thereby exerting an adjustable pressure on the latter.

The movable member can also comprise on the side opposite the screw-spring-ball assembly with respect to the axis of the guide member, a device of the packing type exerting adjustable pressure against the guide member.

Another feature of the invention is that the removable device produces no noise liable to bother the player during use, due to the fact that one at least of the surfaces sliding against one another including the ball, is constituted of a non-metallic material such as an elastomer or a plastics material.

Another feature of the invention is that the removable device is adapted to be attached to a racket including a longitudinal hollow between the frame and the grip, this device comprising, besides the guide member along which the movable member can be displaced, means for attaching the guide member on the one hand to the base of the frame, on the other hand to the grip.

In particular, the attaching means may comprise U-shaped two parts, each being connected at its closed side to one of the ends of the guide member, and at its open end to the base of the frame and to the upper part of the grip respectively, one of the ends of the guide member and the corresponding U part comprising means to increase the separation between the U parts, so that the assembly is held firmly between the frame and the grip.

Another feature is a device comprising a movable member, a guide member and means for attaching the guide member to the frame and to the grip, adopted for attachment to a racket having a continuous axial cavity between the frame and the grip in which the movable element can move, in which device the guide member is attached at one of its ends by a device which permits its release easily without dismantling the means for attaching it to the racket, and at the other hand by a device permitting it to pivot in a plane perpendicular to the frame.

A movable member can thus be easily replaced by another or different weight and the previously released end can be fastened again in its initial position.

Lastly the invention provides a device which is removable or incorporated into the racket, the assembly constituted by the guide member and the movable member being external to the handle of the racket.

In this case the invention relates to a device incorporated into the racket or removable therefrom, comprising a movable member and a guide member constituted by at least one rail provided with means for attaching it to the handle of the racket distributed regularly over the whole of its length between the stringing and the grip, the ends of the rail at the level of the frame and of the grip each comprising a stop member of which one at least is removable.

In order that the invention may be more fully understood, several embodiments thereof are described below in conjunction with the accompanying drawings, purely by way of example. In the drawing:

FIG. 1 is a diagram illustrating the effect of the movable member in various positions.

FIG. 2 is a plan view showing a racket equipped with a first embodiment of my invention;

FIG. 3 is a perspective view showing a modification of the device according to the invention;

FIG. 3A is a sectional view taken along the line A—A of FIG. 3;

FIG. 4 shows another embodiment of the invention comprising a U-shaped movable member;

FIG. 5 is an exploded perspective view of yet another embodiment of the invention, with the movable member sectioned to show the ball and spring in its cylindrical recess;

FIG. 5A is an end view of the embodiment of FIG. 5;

FIG. 6 is a fragmentary side view of the embodiment of FIG. 5, with part of the movable member broken away to expose the ball and spring;

FIG. 7 is a side view of the guide member and ball of yet another embodiment of the invention;

FIG. 7B is a transverse sectional view taken through both the movable and guide members of the embodiment of FIG. 7;

FIG. 8 is a side view of a guide member showing the means for attaching it to the racket;

FIG. 9 is a side view showing a racket comprising a guide member adapted to be hooked to the frame thereof;

Figure 10:
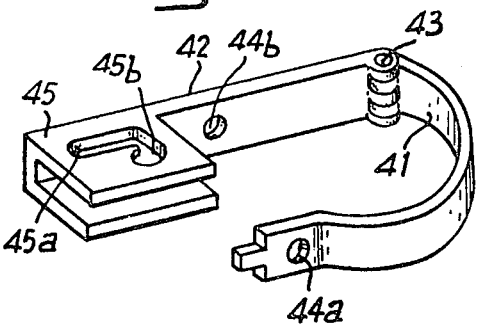
FIG. 10 is a perspective view showing another device for attaching a guide member to a racket.

FIG. 2 shows a racket with an axial cavity in which 1 denotes the grip, 2 a recess in the grip, **3*b* and 3*c* the lateral arms of the racket, 4 the base of the frame, 5 the stringing, 6 the guide member, 7 the end of the guide member attached to the inside of the grip, 8 the movable member, 9 means for the fastening and releasing the movable member, 10 the other end of the guide member encircling the base of the frame, and 11 the means of fastening the afore-said end 10** to the base of the frame.

FIG. 3A shows in perspective view and FIG. 3B shows in longitudinal section with respect to the guide member, a modification of the movable member 8. In this modification, the parallelepipedic guide member 6 comprises recesses 6*a* capable of receiving a pin 8*a* having sloping edges 8*g* arranged in corresponding manner on the base 8*b* of the movable member; this base 8*b* being itself biased against the guide member by means of the opposing spring 12 inside the upper part of the movable member.

Pressure on the upper part of the movable member at 8*c* permits displacement of the pin 8*a* form the opening 6*a* of the guide member in which it is engaged, and thus the release of the movable member, which can then be displaced to a new orifice 6*a* among these arranged at preset positions for this purpose on the guide member.

FIG. 4 shows an embodiment of the movable member comprising a U shaped part 13 provided with a collar 13*a* through which the guide member 6 passes and whose inner diameter is greater than that on the bosses 15 of the guide member, the arms 13*b* and 13*c* of the afore-mentioned U part being terminated by threads 14*b* and 14*c* each capable of receiving a corresponding nut (not shown). The U-shaped part can receive on the one hand one or several braking members 16 of a sufficiently elastic material having orifices 16*b* and 16*c* receiving the arms 13*b* and 13*c* and an orifice 16*a* receiving the guide member, the afore-said orifice having a diameter less than that of the bosses 15, and on the other hand one or several weighting members 17 mounted in the same manner as the members 16 but with the orifice receiving the member 6 having a diameter at least equal to that of the bosses 15 and the diameters of the members 17 being less than that of the members 16.

The assembly of elements 16 and 17 selected to obtain the desired weight is then fastened as desired by nuts screwed on to the threads 14*b* and 14*c* to adjust the braking.

In other modification, the bosses 15 are replaced by circular slots at several suitable positions of the guide member and the thickness of the members 16 is then less than the width of the afore-said slots, whilst the orifices 16*a* are slightly smaller in diameter than the cross-section of the guide member.

The movement of the movable member of FIG. 4 is then obtained by pushing it even with a single finger along the guide member, only when this is desired in view of the braking force to be overcome, which can be adjusted as desired by tightening the nuts or by increasing the number of braking members.

FIG. 5A shows on the one hand in perspective view a part of the movable member including a cross-section perpendicular to the axis of the guide member at the level of the fastening and releasing device, and on the other hand a view of one of the sides bounding the movable member perpendicularly to the guide member, the latter being arranged along the axis of the racket perpendicularly to the plane of the frame.

FIG. 5B is an end view of the embodiment illustrated in FIG. 5A.

In the afore-mentioned FIG. 5, 18 denotes the body of the movable member, 6 the guide member, 19 the cross-section at the level of the fastening device constituted by a bore 20 perpendicular to the small side of the guide element, a screw 21 displaceable in the threads 22 to compress the spring 23 against the ball 24 in contact with the side 6*a* of the guide member passing through an opening in the movable member the side 25*a* of which is seen, and the width of which is less than the diameter of the ball.

The recess 26 perpendicular to the guide member receives a member 26*a*, of non-metallic material, preferably constituted by an elastomer or a sufficiently rigid plastics material, such as nylon, polyesters, polyolefins, if necessary reinforced, the sides 26*b* and 26*c* of which are visible. The guide member passes through an opening in the member 26*a* of the same cross-section but slightly smaller dimensions than those in the opening of the movable member.

The tappings 27 and 27*a* serve for fastening the cover 28 between the sides of the opening 29 which holds the packing 29*a* whose pressure against the side 6*b* of the guide member is adjustable by means of the screw 30, while the notch 26*d* receives the side 26*b* of the non-metallic element.

The recess 31 opposite the ball 24 receives the latter when the movable member along the guide member, which ensures its location at the level of this recess. As clearly seen in FIG. 5A the recess 31 is arcuate in a plane parallel to the side 25*a* so as to provide slopes up which the ball 24 may ride when moving out of the recess, longitudinally of the guide member 6. The depth of the bore 20 is sufficient to permit the ball to reach the bottom of the afore-said recess.

The movable member is released by simply pushing it along the guide member, which causes the ball 24 to emerge from the recess 31.

The movable member comprises a part symmetrical with respect to the section 19 and notably a notch similar to the notch 26 to provided with a second non-metallic member 26*a* similar to the first and through which the guide member 6 also passes. The end 32 of the member 26*a* includes an orifice 32*a* by means of which it is attached to the grip.

On the side 33 of the movable member perpendicular to the axis of the guide member, is the opening 25 in the movable member having the sides 25*a* and 25*b* as well as the closure part 28. The sides 26*b* and 26*c* of the non-metallic member 26*a* are indicated by a broken line, the opening 34 in this member being indicated by a solid line.

The non-metallic members 26*a* arranged on both sides of the screw-spring-ball assembly ensure the sliding of the movable member along the guide member thereby avoiding any metal against metal contact, which eliminates any noise during play.

These non-metallic elements are made of plastics material such as already mentioned above.

The ball 24 is generally metallic, but it is advantageous to use a ball of plastic material of sufficient hardness.

Generally, one at least of the sliding surfaces of the movable member or of the guide member is preferably of non-metallic material such as indicated above.

For example the guide member may be made entirely of, or only covered with a sheath, of such a material, the movable member being then metallic. Conversely the guide member may be metallic, the movable member being constituted by a core of plastics material comprising the screw-spring-ball assembly and recesses designed to receive the metallic weighting members.

FIG. 6 shows in axial cross-section, perpendicularly to the frame, a movable member 18 sliding along a parallelepipedic guide member 6. As in FIG. 5, there can be seen the bore 20, the screw 21, the screw thread 22, the spiral spring 23, the ball 24 housed in the recess 31 and the screw thread 27 for attaching the closure member 28 (not shown). The boss 18*a* of the movable member enables the length of the spring 23 to be increased.

A device 35 of the packer type in strip form, is housed in a groove in the movable member perpendicularly to the plane of the frame, fastened through tappings 27*b* and 27*c* and adjustable by means of a screw (not shown) against the guide element. 36 represents a cylindrical packer device, also adjustable by screwing against the guide member, the movable element comprising the devices 35 and 36 on each of its sides with respect to the guide member.

FIG. 7 shows a cross-section 19*a* of a cylindrical movable member 18*b*, perpendicular to a cylindrical guide member 6*c*, this section being taken at the level of the screw-spring-ball assembly. The Figure shows the bore 20, the screw 21, the tapping 22, the spring 23, and the ball 24, as well as the cylindrical aperture 25*c* through which the movable member is threaded on to the guide member whose groove 31*a* is adapted to the ball.

As best seen in FIG. 7, an axial section taken through the member 6*a* shows that the bottom of the groove 31*a* is arcuate in the plane of said section, so as to provide slopes up which the ball 24 may ride when moving out of the groove, longitudinally of the guide member 6*a*.

The movable member 18*b* can include the devices 26*a*, 35 and 36 of FIGS. 5 and 6.

When the adjustment between the aperture of the movable member and the guide member is sufficiently accurate, the afore-said devices 26*a*, 35 and 36 can of course be eliminated, but it is then desirable to equip the movable member with two screw-spring-ball assemblies, arranged at its ends and preferably on opposite sides of the axis of the guide member.

FIG. 8 shows an embodiment of the device according to the invention, comprising on the one hand a clamp 37 the sides 37*a* and 37*b* of which bear against flats on the grip, with the side 37*c*, becoming applied against the upper part of the grip, and on the other hand a stirrup arranged so that the side 38*c* is urged against the base 4 of the frame. The side 37*c* of the clamp has a central orifice 37*d* receiving the guide member 6 whose end 6*e* is spaced from the orifice 37*d* and the side 38*c* of the stirrup carries its connecting arm its a female part 38*d* provided with a screw thread, into which can be screwed the other threaded end 6*a* of the guide member. The knurled screws for the clamp and to the stirrup are not illustrated in the Figure.

In a modification, the female part 38*d* is replaced by a spindle provided with a reverse threads with respect to the threading 6*a* of the guide element. These two threads are then connected by a female part having corresponding screw-threads.

FIG. 9 shows a racket with an axial cavity according to the invention, and in which the lower part of the frame 4 includes a part 4*a* provided with a ring 4*b* designed to receive the hooked end 6*d* of the guide member 6. FIG. 9 also shows the movable member 8, with the fastening and release means for the movable member at 9 and the grip 1. The threaded end of the guide member 7 is received in the hollow correspondingly threaded cylindrical part 39 of the knurled screw 40 which can be introduced axially at the base of the grip by means of an opening for this purpose, the grip 1 itself including a suitable axial cavity permitting the passage of the guide member 6.

The arms 3*b* and 3*c* of the racket have not been illustrated to facilitate the reading of the Figure.

The assembly of the device according to the invention is effected in the following manner:

The movable member is placed on the guide member, the end 7 of the guide member is engaged in the bore in the grip and the end 6*d* of the guide member is then engaged in the ring 4*b* of the part 4*a*. The knurled screw 40 is then screwed around the end 7 of the guide member through the orifice (not shown) situated at the base of the grip and the screwing is continued until the guide member 6 is held with sufficient tension between the part 4*a* and the knurled 40, the degree of screwing enabling the flexibility or rigidity of the racket to be adjusted also.

FIG. 10 illustrates a particularly suitable device, for attaching the guide member to the base of the frame of a racket having a continuous axial opening between the frame and the grip in which the movable member can travel, for example in the case of a racket provided with arms connecting the frame to the grip.

This device comprises a curved member 41 pivoted by a spindle 43 to an member 42 so that by inserting a screw through the orifice 44*a* of the member 41 and the tapping 44*b* of the member 42, the afore-said device can be attached firmly to the base of the frame, with the member 41 passing between two neighbouring strings, and the U part 45 of the member 42 becoming positioned below the frame along the longitudinal axis of the racket. Each of the sides of the afore-said U part perpendicular to the plane of the frame, includes an angular aperture 45*a*, 45*b*; through these aperatures passes a spindle (not shown) one end of which is terminated externally at the U part by a head which cannot pass through the aperature 45*a*, 45*b* from one side of the U part whilst the other end of the spindle is terminated by threads receiving a hollow tapped screw which can traverse the aperature 45*a*, 45*b*, from the opposite side of the U part and be attached by screwing the guide member between the sides of this U part.

Figure 11:
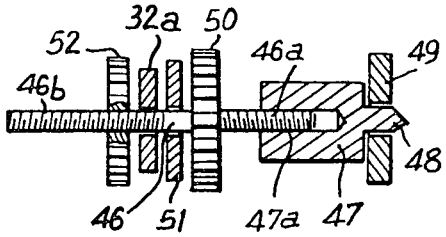
FIG. 11 is a sectional view through another device for attaching a guide member to the grip of a racket.

FIG. 11 shows a modification of the device for attaching the guide member to the grip of a racket having an axial opening as mentioned for FIG. 10.

This device includes a spindle 46 whose ends 46*a* and 46*b* have reverse threads. The cylindrical part 47 can be screwed by means of its threads 47*a* on to the threads 46*a*, and includes a head 48 receiving an elastic member 49; a similar part (not shown) corresponds to the threads 46*b*. The knurled screw 50 drives the spindle 46 and causes the movement of the part 47 towards the inner surfaces the arms of the racket on opposite sides of said aperature against which the elements 48, 49.

FIG. 11 shows the orifice 32*a* of the guide member through which the spindle 46 passes, a seal 51 and a knurled nut 52 for immobilizing the guide member against the knurled screw 50.

Figure 12:
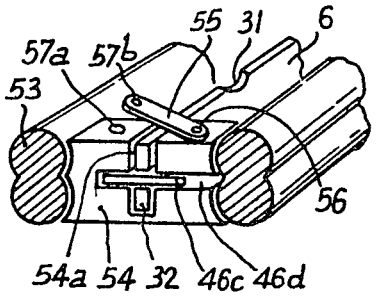
FIG. 12 is a perspective view of yet another device for attaching a guide member to a racket.

FIG. 12 shows in vertical section with respect to the axis of the racket, another modification of the device for attaching the guide member to the grip of the racket including an axial opening as mentioned for FIGS. 10 and 11. The drawing shows the arms 53 of the racket, and the attaching member 54 constituted of elastic, but sufficiently rigid, material the curve of which is adapted to the inner surface of the arms 53 between which it is force-fitted.

Figure 13:
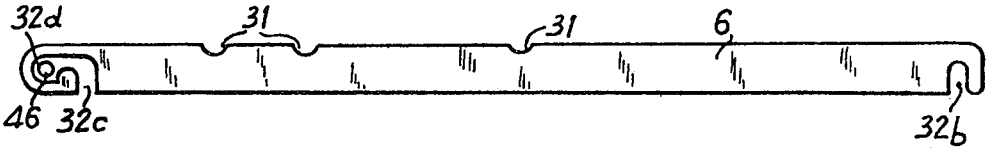
FIG. 13 is a side view of a guide member.

The member 54 includes, on the one hand in its middle-part perpendicular to the axis of the racket, a cylindrical cavity 46*d* in which is housed the pin 46*c* passing through an orifice (not shown) to the end of the guide member 32, and on the other hand a slot 54*a* along the axis of the racket perpendicular to the plane of the frame, through which the guide member can be introduced up to the spindle 46*c* by means of the cavity 32*b* of the guide member according to the following FIG. 13.

The bolt 55 pivoting around the pin 56 and fixed to the member 54 by a screw (not shown) passing through tapping 57*a*, and through the orifice 57*b* of the bolt 55, fastens the guide member to the grip. In this Figure, the guide member 6 and a notch 31 can be seen.

Of course the fastener of FIG. 12 may be constituted by the member 54 including only the slot 54*a*, of which the upper part is not open.

FIG. 13 shows a guide member 6 of parallelepipedic section one of the ends of which includes the slot 32*c*, 32*d* adaptable to the device of FIG. 11, the spindle 46 of which can be seen in cross-section or may cooperate with the cavity 45*a* and 45*b* of the device of FIG. 10 through which passes a spindle and a clamping screw (not shown). The other end of the guide member 6 has a slot 32*b* which becomes engaged on the spindle 46*c* of FIG. 12. The grooves 31 of the guide member are also seen.

The ends of the guide member may include only the circular orifices 32*a* of FIG. 5; however it is preferable that one at least of the ends includes a slot 32*c*, 32*d* or a slot 32*b*. In fact, a guide member provided with an orifice 32*a* may be threaded on to the spindle 46 or on to the spindle 46*c* around which it can pivot; while the other end provided with slot 32*c*, 32*d* can become engaged on the spindle (not shown) between the sides of the U part 45 and be fastened there once the movable member has been threaded on to the guide member. Thus one movable member can be rapidly replaced by another. In the same way, a guide member whose end has a slot 32*a*, may be fixed to the device of FIG. 10, the other end provided with a slot 32*b* becoming engaged on the spindle 26*c* of the device of FIG. 12, locking with the part 55 then being effected. Here again, the replacement of a movable member by another may be rapidly effected.

Figure 14:
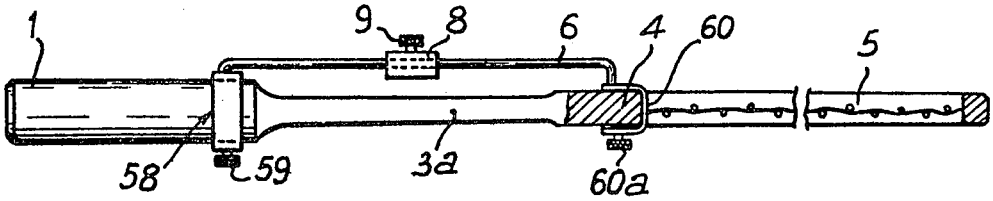
FIG. 14 is a side view of another embodiment of the device according to the invention mounted on a racket.

FIG. 14 shows a racket in side view, provided with the device according to the invention in the case where the guide member and the movable member are external to the handle of the racket.

The afore-said Figure shows the grip 1, the handle 3*a*, terminated by the base of the frame also called "boomerang" 4, the frame being shown at 5. This racket is equipped with a device according to the invention which includes the guide member 6, the movable member 8, attaching and release means for the movable member at 9, a fastener; 58 fixed on the grip above the position serving for gripping the racket by means of the knurled screw 59 as well as the fastener at the base of the frame including a stirrup 60 fastened by means of the knurled screw 60*a*.

Figure 15:
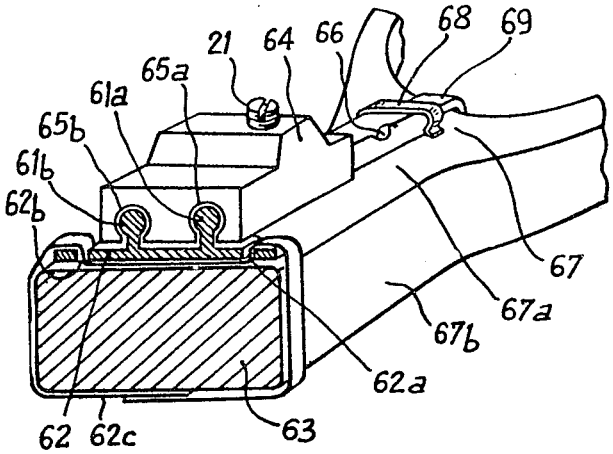
FIG. 15 is a perspective view showing another embodiment of the invention mounted on a racket.

FIG. 15 shows in perspective view the device of the invention adapted to a racket whose handle does not include the axial opening between the base of the frame and the grip.

The section 63 perpendicular to the axis of the racket shows the guide member constituted by two rails 61*a* and 61*b* arranged parallel to the axis of the racket and united by the cross-piece 62 having the orifices 62*a* and 62*b* therein through which passes the self-adhesive strip 62*c* which holds the guide member against the side 67*a* of the handle of the racket. The afore-said rails, comprising several cross-pieces 62 between the base of the frame 67 and the grip are terminated, on the one hand, at the level of the frame by a stop 68 and a projection 69 passing between two central strings and curved so as to be clamped against the side opposite to the side 67*a*, and on the other hand, at the level of the grip, by another stop (not shown) and, which is removable. The movable member 64, on which only the screw 21 of the screw-spring-ball device is shown, slides between the afore-said rails which it receives grooves 65*a* and 65*b* whose section mates with that of the rails, comprising a narrow part and an enlarged part, so as to render the movable member inseparable from the guide member between the base of the frame and the grip. The drawing also shows the hole 66 perpendicular to the rail 61*a* and cooperating with the screw-spring-ball device controlled by the screw 21. In the modification, the screw-spring-ball device may advantageously be placed horizontally between the two rails 61*a* and 61*b*, with the recesses receiving the ball then occuring on the side of the rail facing the ball.

Of course the embodiments of the racket according to the invention of FIGS. 2 and 9 and/or of the removable device of FIGS. 3 to 8 and 10 to 15 may include numerous modifications especially with respect to the guide members, the movable member, the means for attaching the guide member to the appropriate parts of the frame and of the grip, as well as the means enabling the movable member to be immobilized on the guide member.

The guide member can have any cross-section and may also be also mounted in any manner between the base of the frame of the racket and the grip, with the sole condition that the movable member can always slide freely along the guide member and that the means enabling it to be immobilized on the guide member, or to be released instantaneously, are always accessible. The guide member can have a round, square, rectangular or trapezoidal cross-section, be arranged along the axis of the grip and of the handle or parallel to this axis in the plane of the frame of the racket or in a plane perpendicular to the frame of the racket and be constituted by one or several separate parts.

Each of the arms of a metal racket may besides be used also as a sectional guide member.

The means for attaching the guide member to the frame and to the grip can be the most diverse, and according to one modification the base of the frame at 4 includes an orifice provided with a screw thread into which the end of the sectional element having mating threads can be screwed. This modification corresponds to FIG. 9 in which the part 4*a* is replaced by a threaded female part and the terminal hook 6*d* of the guide member is replaced by a threaded end.

In another modification the means for attaching the guide member to the frame and to the grip are constituted by two U shaped parts attached at their closed end to two ends of a telescopic guide member the length of which can be increased so that the assembly is held firmly between the grip and the base of the frame of a metallic racket.

In the case of a racket including two arms and/or an opening between the grip and the base of the frame, in a particularly advantageous modification of the invention, the guide member is constituted by a hollow rod and the means for attaching it to the base of the frame are constituted by a sectional steel member forming a loop which encircles the frame at the base of the frame while each end of the member is engaged over a length of several centimeters inside the hollow rod and held flat against the opposite inner walls of the afore-said rod, by reason of the spring effect of the steel loop.

The movable member may have the most varied shapes such as parallelepipedic, cylindrical or composite. This is also true of the members mounted on the movable member and whose weight is preferably a multiple of a ¼ oz., that is to say of 7 grams.

Moreover, any similar device to that of FIGS. 3 to 7 which permits the fastening of the movable member to the guide member and its release, can also be used.

Applicant has also noted that a particularly advantageous embodiment of the racket according to the invention was one in which the movable member was positioned against the frame, the centre of gravity of the part of the racket situated above the grip being thus positioned between the geometric centre of the frame and the base of the frame at a distance less than 5 centimeters from the afore-said geometric centre.

The invention also therefore provides a racket equipped with a device comprising a movable member sliding along a guide member, and in which, when the movable member is placed against the frame, the centre of gravity of the part situated above the frame is located at a distance less than 5 centimetres from the geometric centre of the frame.

For this purpose, the end of the frame remote from the middle of the racket includes an incorporated or removable load, distributed symmetrically with respect to the axis of the racket and to the plane of the frame, this load being such that, for a racket of a pre-determined weight, including here the weight of the device comprising the guide member, the movable member, and the means for attaching the guide member to the frame and to the grip, the afore-said centre of gravity occupies the above-indicated position, the frame being also lightened in consequence.

When the load is removable, and consequently interchangeable, it is constituted preferably by a weighting member removably mounted on the upper part of the frame at at least two points symmetrical with respect to the axis of the racket. The shape of this member may be very varied as well as its mode of attachment.

Preferably, it is constituted by a curved and rigid U shaped channel section, nesting on the upper part of the frame and at its periphery, the sides of the channel section parallel to the plane of the frame being clamped by suitable screw means, the rigidity of the channel section contributing to increasing the strength of the frame.

In a preferred embodiment, the sides of the channel section are extended at least at their ends above the frame and are held clamped against the frame by screwing them to the frame.

For a racket equipped with the removable device according to the invention and including a load at the top of the frame, a particularly suitable modification of the device is one in which the guide members is attached, on the one hand to the base of the frame, and to the other hand at the end of the grip opposite the frame by at least one screw means permitting the guide member to be tensioned between the frame and the grip.

The table below indicates by way of representative examples the weight and dimensional characteristics of the principal parts of two rackets according to the invention;

| | Example 1 | | Example 2 | |
|---|---|---|---|---|
| | weight in g. | length in cm. | weight in g. | length in cm. |
| grip | 118 | 20 | 86 | 17 |
| central part | 46 | 20 | 56 | 22 |
| guide member and attachments | 19 | | 20 | |
| movable member | 28 | | 28 | |
| frame | 116 | 27 | 124 | 26 |
| load at the head of the frame | 70 | | 80 | |
| total weight | 397 | | 390 | |
| total length | | 67 | | 65 |

Example 1 relates to a racket called a 14, that is to say 14 oz. (397 g) here including the movable member weighing 1 oz. (28 g) and the load at the head of the stringing (70 g) with which it is equipped. The afore-said load is constituted by a member in the shape of a channel section along the curve of the top of the frame, having a length of 16 cm and fixed at its two ends by screw means passing through the frame against the inner side frame of the frame. This racket may be equipped with a movable member of ½ to 1 ¾oz. (namely 14 g to 49 g)

Example 2 relates to a racket called a 13 ¾, that is to say weighing 13 ¾oz. (390 g) and including the movable member weighing 1 oz. (28 g) and the load at the top of the frame (80 g) with which it is equipped. The afore-said load is incorporated with the frame frame and distributed in a regular manner over a total length of 12 cm. This racket may be equipped with a movable member of ½ to 1 ½oz. (namely 14 to 42 g).

It is advantageous to equip the rackets of examples 1 and 2 with a guide member attached by screwing it between the base of the frame and the end of the grip opposite the frame.

What I claim is:

1. Tennis racket comprising a frame and a handle attached to said frame, said handle comprising a grip at the end thereof remote from the frame, a single elongated guide member extending between said grip and frame, said guide member having a non-circular section and being provided with a plurality of longitudinally spaced recesses therein, a movable member mounted to slide longitudinally along said guide member in response to pressure exerted on said movable member longitudinally of said guide member, and resiliently biased stop means carried by said movable member and dimensioned to project into any one of said recesses so as to releasably retain said movable member at any one of a plurality of different positions longitudinally spaced along said guide member, said stop means and the recesses in said guide member having cooperating surfaces transverse to said guide member, at least one of which is so sloped that only resilient resistance to sliding movement of said movable member is provided when said stop means projects into one of said recesses.

2. Tennis racket as claimed in claim 1 in which said resiliently biased stop means is a ball which is positioned at one end of a spring, said spring is seated in a threaded bore in said movable member, the other end of said spring abuts against an adjusting screw in said bore, said movable member has a passageway therein which receives said guide member, and said bore intersects said passageway.

3. Tennis racket as claimed in claim 2 in which said movable member has a passageway therein which receives said guide member, said spring-biased ball being seated in one wall of said passageway and packing means urging said guide member against said ball being carried on the opposite wall of said passageway said movable member further comprising means for adjusting the pressure exerted by said packing means.

4. Tennis racket as claimed in claim 2 in which said movable member has non-metallic components positioned to prevent contact between metallic parts of said movable and guide members.

5. Tennis racket as claimed in claim 4 in which said non-metallic components extend perpendicularly with respect to the longitudinal axis of the guide member and define orifices which slidably receive said guide member.

6. Tennis racket as claimed in claim 2 in which said guide member has a polygonal section and said recesses lie in a straight line parallel to the longitudinal axis of said guide member.

7. Tennis racket as claimed in claim 6 in which the diameter of said ball is larger than that of said passage.

8. Tennis racket as claimed in claim 2 in which the diameter of said ball is larger than that of said passageway.

9. Tennis racket as claimed in claim 1 in which said handle has a longitudinal cavity between said frame and grip and comprising means for removably attaching the ends of said guide means to said frame and grip respectively.

10. Device as claimed in claim 9 in which the means for attaching said guide member to said frame comprises two relatively movable parts, one for attachment to the frame and one for attachment to the guide member.

11. Tennis racket comprising a frame and a handle attached to said frame, said handle comprising a grip at the end thereof remote from the frame, a single elongated guide member extending between said grip and frame, said guide member having a circular section and being provided with a plurality of longitudinally spaced recesses therein, said recesses completely encircling said guide member, a movable member mounted to slide longitudinally along said guide member in response to pressure exerted on said movable member longitudinally of said guide member, and resiliently biased stop means carried by said movable member and dimensioned to project into any one of said recesses so as to releasably retain said movable member at any one of a plurality of different positions longitudinally spaced along said guide member, said stop means and the recesses in said guide member having cooperating surfaces transverse to said guide member, at least one of which is so sloped that only resilient resistance to sliding movement of said movable member is provided when said stop means projects into one of said recesses.

* * * * *